US010583583B2

(12) United States Patent
Dutterer

(10) Patent No.: US 10,583,583 B2
(45) Date of Patent: Mar. 10, 2020

(54) TABLE JOINING MECHANISM

(71) Applicant: TTI (MACAO COMMERCIAL OFFSHORE) LIMITED, Macau (MO)

(72) Inventor: David E. Dutterer, Belton, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 295 days.

(21) Appl. No.: 15/443,773

(22) Filed: Feb. 27, 2017

(65) Prior Publication Data

US 2017/0252947 A1 Sep. 7, 2017

Related U.S. Application Data

(60) Provisional application No. 62/301,925, filed on Mar. 1, 2016.

(51) Int. Cl.

| | |
|---|---|
| ***B28D 7/04*** | (2006.01) |
| ***B28D 1/04*** | (2006.01) |
| ***B28D 7/02*** | (2006.01) |

(52) U.S. Cl.

CPC ..... *B28D 7/04* (2013.01); *B28D 1/04* (2013.01); *B28D 1/047* (2013.01); *B28D 7/02* (2013.01)

(58) Field of Classification Search

CPC . B28D 1/04; B28D 1/047; B28D 7/02; B28D 7/04

USPC ..... 125/13.01

See application file for complete search history.

(56) References Cited

U.S. PATENT DOCUMENTS

| | | | | |
|---|---|---|---|---|
| 3,635,206 | A | 1/1972 | Harclerode | |
| 3,807,095 | A * | 4/1974 | Harding | B23D 47/025 125/13.03 |
| 4,428,159 | A * | 1/1984 | Sigetich | B28D 1/047 125/13.03 |
| 5,842,400 | A | 12/1998 | Mcintosh | |
| 6,000,387 | A * | 12/1999 | Lee | B23D 47/025 125/11.22 |
| 6,080,041 | A | 6/2000 | Greenland | |
| 6,199,608 | B1 | 3/2001 | Ayala | |
| 6,276,990 | B1 * | 8/2001 | Greenland | B23D 47/02 125/13.03 |
| 6,347,624 | B1 | 2/2002 | Smith | |
| 6,427,677 | B1 | 8/2002 | O'Banion | |
| 6,508,244 | B2 | 1/2003 | Lee | |
| 6,508,281 | B1 | 1/2003 | Wang | |
| 6,679,244 | B1 * | 1/2004 | Tsao | B28D 1/047 125/13.01 |
| 6,748,987 | B2 | 6/2004 | Ayala | |
| 6,845,768 | B2 | 1/2005 | O'Banion | |

(Continued)

*Primary Examiner* — Eileen P Morgan

(74) *Attorney, Agent, or Firm* — Michael Best Friedrich LLP

(57) ABSTRACT

A tile saw including a saw unit having a motor and a saw blade, and a base supporting the saw unit above the base, where the base is fixed relative to the saw unit. A carriage is supported by the base. The carriage is translatable relative to the base and the saw unit, where the carriage is translatable along a first plane. The tile saw further includes a table for supporting a work piece to be cut by the saw blade. The table is translatable relative to the base and the saw unit, where the table is translatable along a second plane. The second plane is parallel to the first plane. The table is selectively translatable relative to the carriage.

20 Claims, 16 Drawing Sheets

(56) References Cited

U.S. PATENT DOCUMENTS

| | | | | |
|---|---|---|---|---|
| 6,874,399 | B2 * | 4/2005 | Lee | B23D 45/02 125/13.03 |
| 7,048,021 | B2 | 5/2006 | Ayala | |
| 7,066,068 | B1 | 6/2006 | Caldwell | |
| 7,308,844 | B2 | 12/2007 | Sheddy | |
| 7,328,639 | B2 | 2/2008 | Sheddy | |
| 7,387,120 | B2 * | 6/2008 | O'Banion | B23D 45/02 125/13.01 |
| 7,455,003 | B2 | 11/2008 | Sheddy | |
| 7,490,643 | B2 | 2/2009 | Liu | |
| 7,530,377 | B2 | 5/2009 | Ayala | |
| 7,814,947 | B2 | 10/2010 | Ayala | |
| 7,819,111 | B2 | 10/2010 | Wise | |
| 7,823,575 | B2 | 11/2010 | O'Banion | |
| 7,950,315 | B2 | 5/2011 | Sheddy | |
| 8,001,875 | B2 | 8/2011 | Sheddy | |
| 8,167,011 | B2 | 5/2012 | Ayala | |
| 8,286,539 | B2 | 10/2012 | Sheddy | |
| 8,783,240 | B2 * | 7/2014 | Lawlor | B23D 47/045 125/13.01 |
| 2009/0266350 | A1 | 10/2009 | Zhang | |
| 2011/0226110 | A1 | 9/2011 | Sheddy | |
| 2013/0055865 | A1 | 3/2013 | Sheddy | |

* cited by examiner

TABLE JOINING MECHANISM

CROSS-REFERENCE TO RELATED APPLICATIONS

This application claims priority to U.S. Provisional Application No. 62/301,925, filed Mar. 1, 2016, the entire contents of which are incorporated by reference herein.

BACKGROUND

The present invention relates to a table joining mechanism, and specifically, a table joining mechanism for a tile saw or other table-based power tools.

Conventionally, power tile saws include a base which supports a table for supporting a workpiece. A blade assembly is coupled to the base for engaging the workpiece, such as tile or masonry stone. When scoring or cutting the workpiece with the blade assembly, the table is movable relative to the blade assembly such that a straight cut can be performed.

SUMMARY

In one aspect, the invention provides a tile saw including a saw unit having a motor and a saw blade, and a base supporting the saw unit above the base, where the base is fixed relative to the saw unit. A carriage is supported by the base. The carriage is translatable relative to the base, where the carriage is translatable along a first plane. The tile saw further includes a table for supporting a work piece to be cut by the saw blade. The table is translatable relative to the base, where the table is translatable along a second plane. The second plane is parallel to the first plane. The table is selectively translatable relative to the carriage.

In another aspect, the invention provides a tile saw including a saw unit having a motor and a saw blade, and a base supporting the saw unit above the base. A carriage is supported by the base. The carriage is translatable relative to one of the base and the saw unit, where the carriage translatable along a first plane. The tile saw further includes a table for supporting a work piece to be cut by the saw blade. The table is translatable relative to one of the base and the saw unit, where the table translatable along a second plane. The second plane is parallel to the first plane. A joining mechanism is configured to selectively fix the table to the carriage. The table is translatable relative to the carriage when the table is not fixed to the carriage.

In yet another aspect, the invention provides a tile saw including a saw unit including a motor and a saw blade, and a base supporting the saw unit above the base, where the base is fixed relative to the saw unit. A carriage is supported by the base. The carriage is translatable relative to the base, where the carriage translatable along a first distance between a first position and a second position. The tile saw further includes a table for supporting a work piece to be cut by the saw blade. The table is translatable relative to the base. The table is translatable along a second distance between a first extended position and a second extended position, where the second distance being greater than the first distance by an additional distance. The table is fixed relative to the carriage along the first distance, and the table is translatable relative to the carriage along the additional distance.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
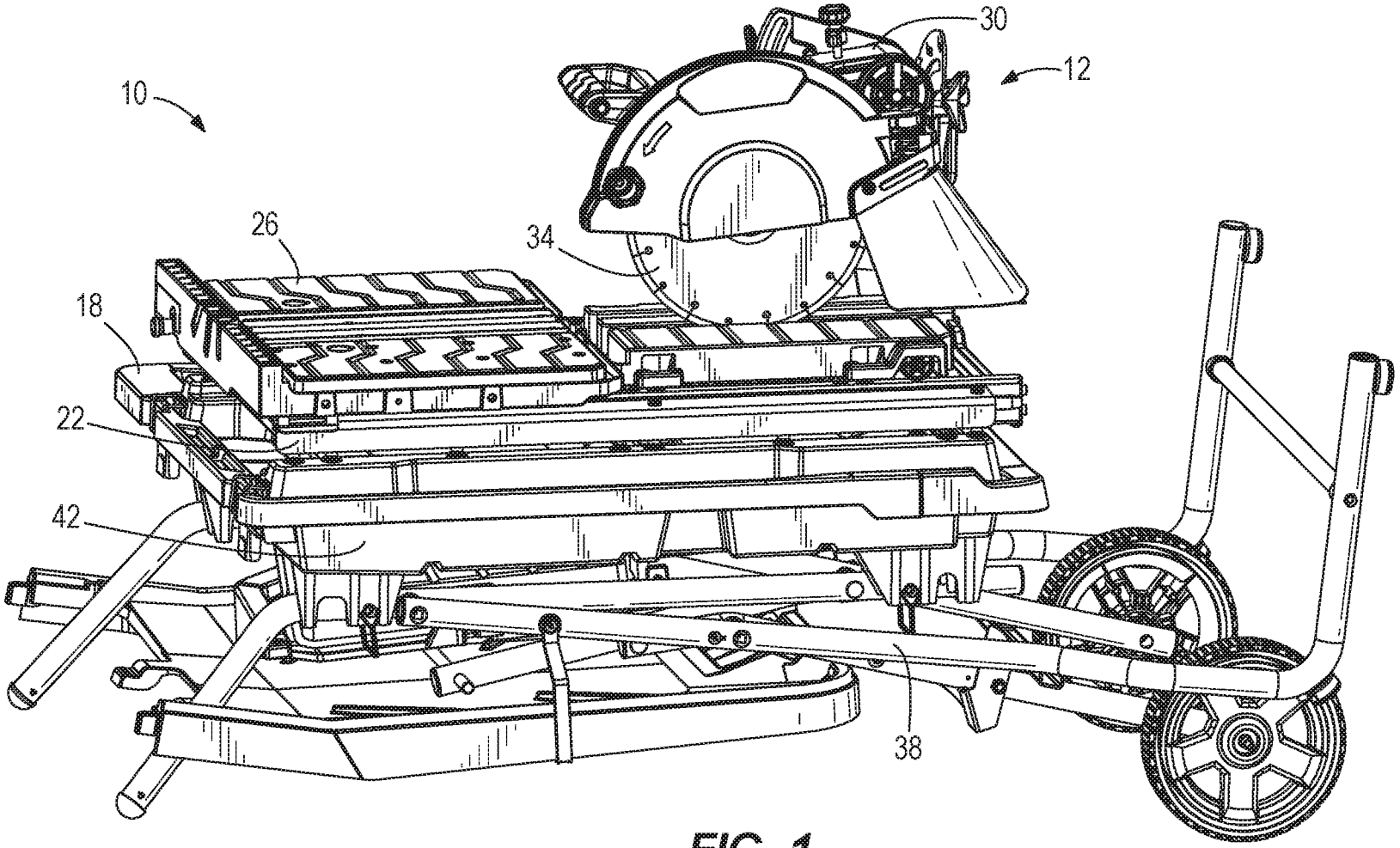
FIG. 1 is a perspective view of a tile saw in accordance with an embodiment of the invention.

FIG. 1 illustrates a tile saw 10 that can be used to accurately and quickly cut workpieces or construction materials such as ceramic, marble, or granite tiles and the like. As illustrated in FIG. 1, the tile saw 10 includes a saw unit 14, a base 18, a carriage 22, and a table 26. During the cutting operation, the workpieces to be cut is placed on the table 26. The saw unit 14 is supported above the table 26 by a saw arm 30 extending from the base 18. The saw unit 14 includes a cutting blade 34 coupled to a motor and operable to cut the workpiece. The motor of the saw unit 14 is electrically-powered (line powered or battery powered) to selectively drive the cutting blade 34.

The base 18 is typically supported by a frame 38. In many constructions, the base 18 includes a basin 42 that contains a quantity of lubricant such as water that cools the cutting blade 34 and carries away debris removed during the cutting process. The base 18 is a structural component that supports the saw unit 14, the table 26, and the carriage 22. In the illustrated embodiment, the base 18 and the saw unit 14 are fixed relative to one another. On the other hand, the table 26 and the carriage 22 are moveable relative to the base 18 and the saw unit 14. In addition, the table 26 and the carriage 22 are selectively movable relative to one another, and selectively fixed relative to one another.

More specifically, the table 26 and the carriage 22 are each slidable along a plane. Specifically, the carriage 22 is slidable along a first plane and the table is slidable along a second plane. The first plane and the second plan are oriented parallel to one another. Additionally, both the carriage 22 and the table 26 are slidable between a first position 70 and a second position 74 to cut the workpiece. As will be described in further detail, the table 26 and the carriage 22 are capable of translating across different distances relative to the base 18.

Figure 2:
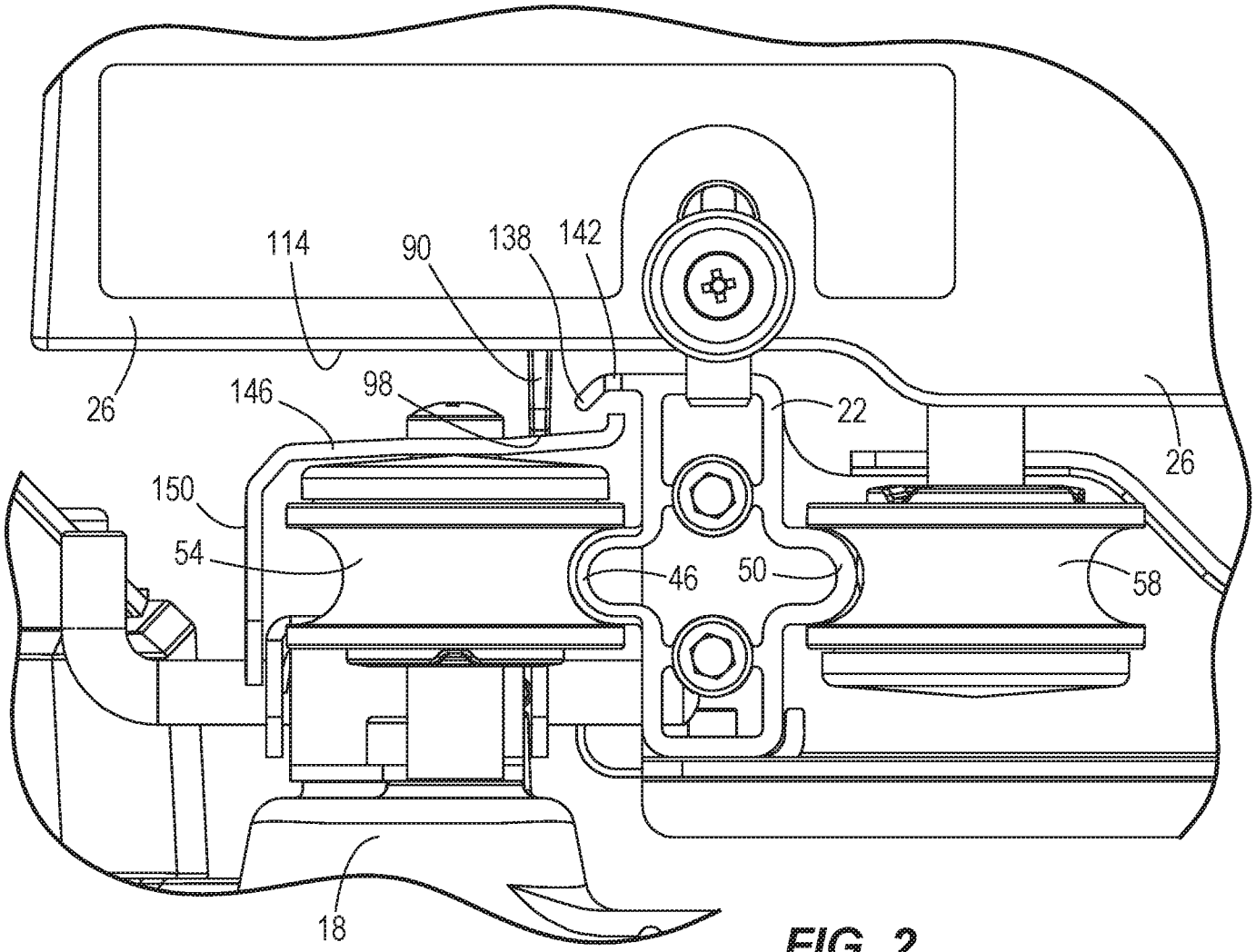
FIG. 2 is a cross-sectional view of a movement mechanism between the base, the carriage, and the table in accordance with an embodiment of the invention.

As shown in FIG. 2, the carriage 22 includes a first rail 46 that enables movement of the carriage 22 relative to the base 18 and a second rail 50 that enables movement relative to the table 26. The base 18 includes a plurality of rollers 54 that interact with the first rail 46 of the carriage 22 to assists in the movement of one or both of the carriage 22 and the table 26 in the horizontal direction. The rollers 54 each rotate about an axis that is perpendicular to the horizontal plane along which the carriage 22 and the table 26 move. Similarly, the table 26 includes a plurality of rollers 58 extending downward from the table 26. The rollers 58 interact with the second rail 50 of the carriage 22 to assist in the movement of the table 26 relative to the carriage 22. The rollers 58 each rotate about an axis that is perpendicular to the horizontal plane. In other embodiments, the arrangement of the rollers 54, 58 and the rails 42, 46 can be varied. For example, rollers can be fixed to the carriage 22 and rails can be fixed to one or both of the base 18 and the table 26. Alternatively, rails can be used on all three of the base 18, the carriage 22, and the table 26. In other embodiments, different types of slide mechanism capable of assisting in the translational movement of the carriage 22 or table 26 can be used to replace the rail and roller system.

Figure 3:
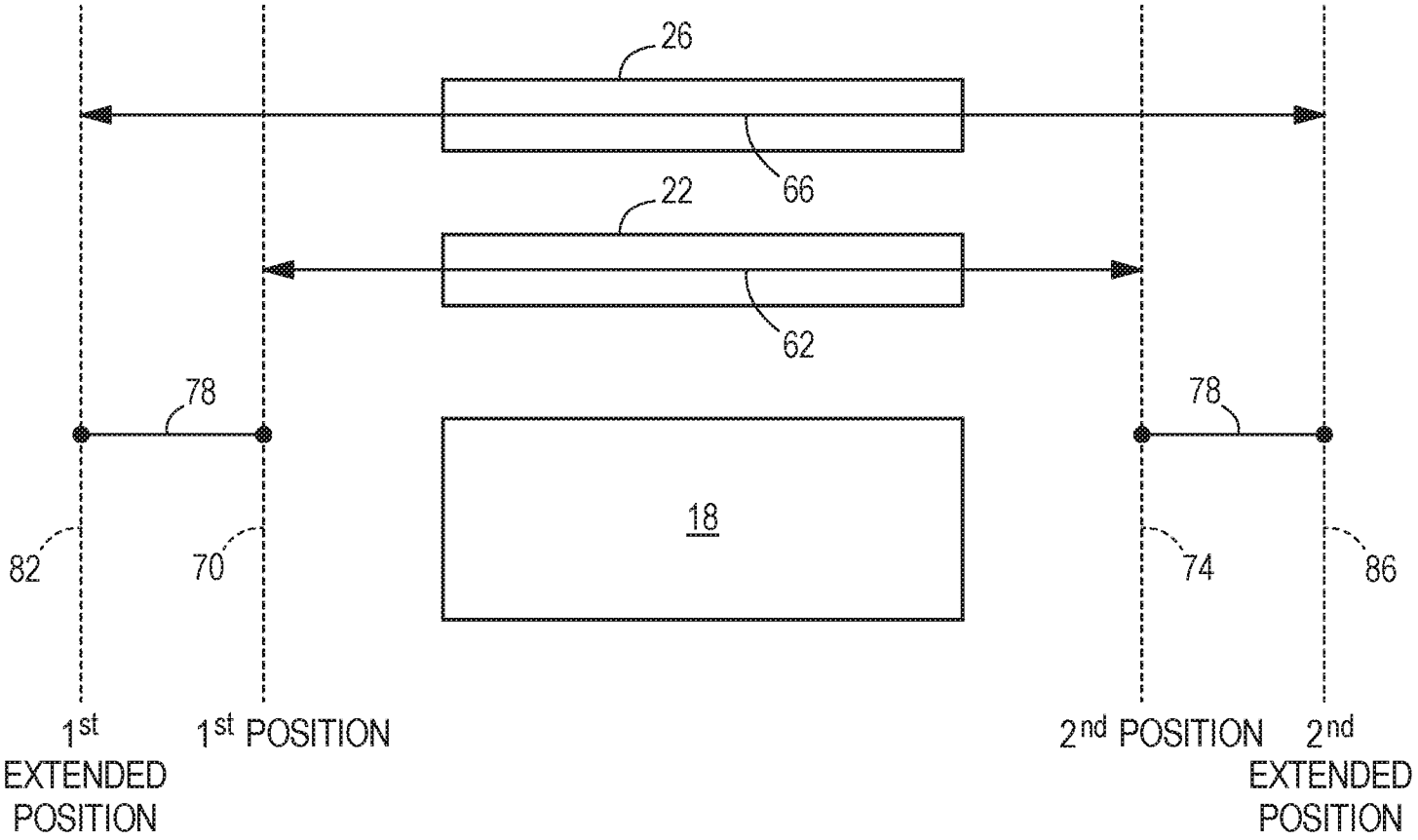
FIG. 3 is a schematic diagram illustrating the movement of the carriage and the table relative to the base 18

FIG. 3 provides a schematic illustration of how the table 26 and the carriage 22 move relative to the base 18. The carriage 22 can translate across a first distance 62 relative to the base 18 and the table 26 can translate across a second distance 66 relative to the base 18. In the illustrated embodiment, the second distance 66 is greater than the first distance 62. In other words, the table 26 can move with the carriage 22 (i.e., fixed relative to the carriage 22) across a first distance 62 between a first position 70 and a second position 74. However, once the carriage 22 stops, the table 26 can translate relative to the table 26 (and the base 18) for an additional distance 78. The table 26 can translate across an additional distance 78 on each side of the carriage 22. The position of the table 26 after translating for an additional distance 78 beyond the first position 70 is referred to as the 1st extended position. Likewise, the position of the table 26 after translating for an additional distance 78 beyond the second position 74 is referred to as the second extended position 86. One or both of the first extended position and the second extended position allows the table to extend beyond the base, the frame, and/or the basin.

Figure 4:
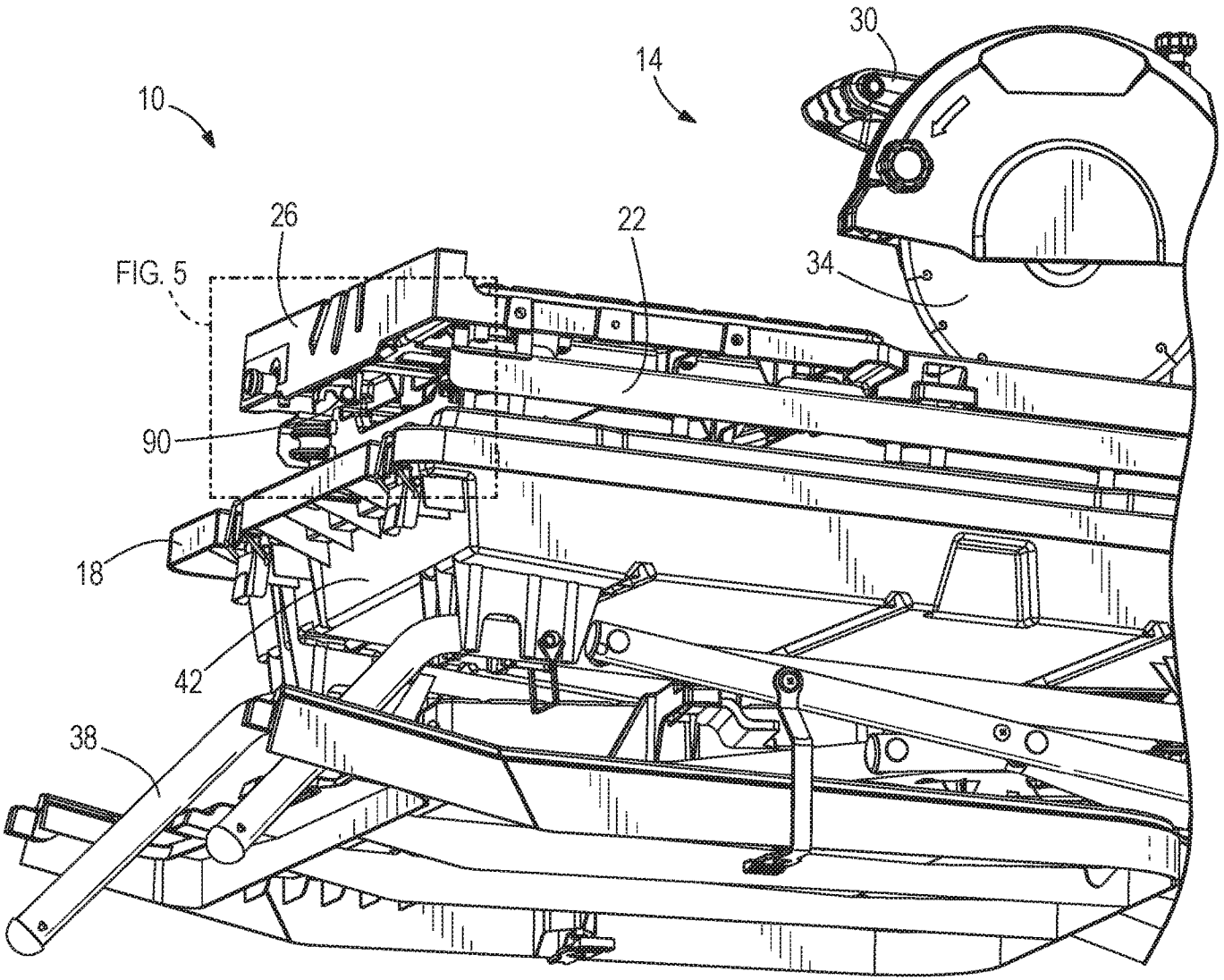
FIG. 4 is a perspective view of a joining mechanism in the tile saw of FIG. 1.
Figure 5:
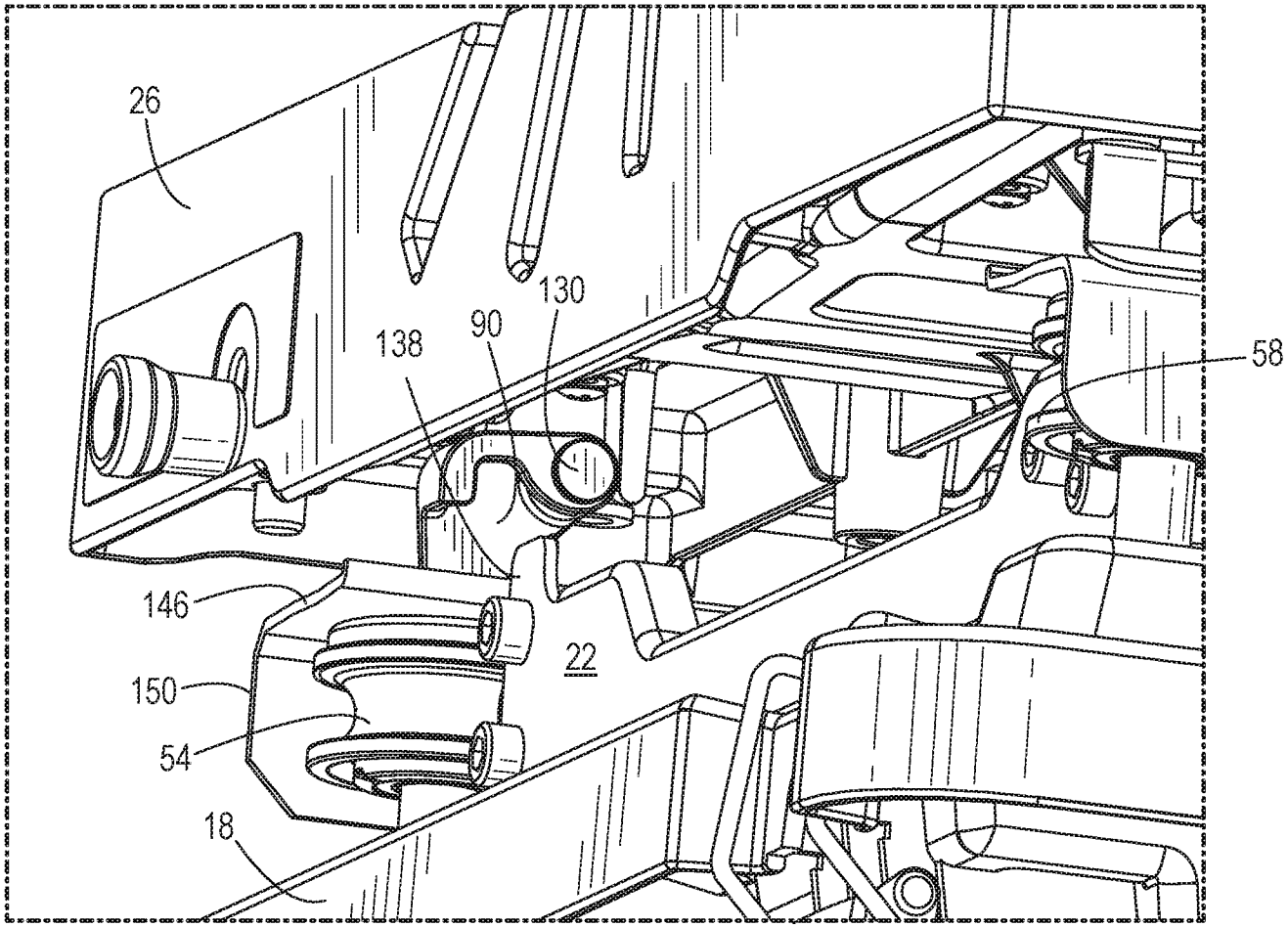
FIG. 5 is an enlarged perspective view of the joining mechanism of FIG. 4.
Figure 6:
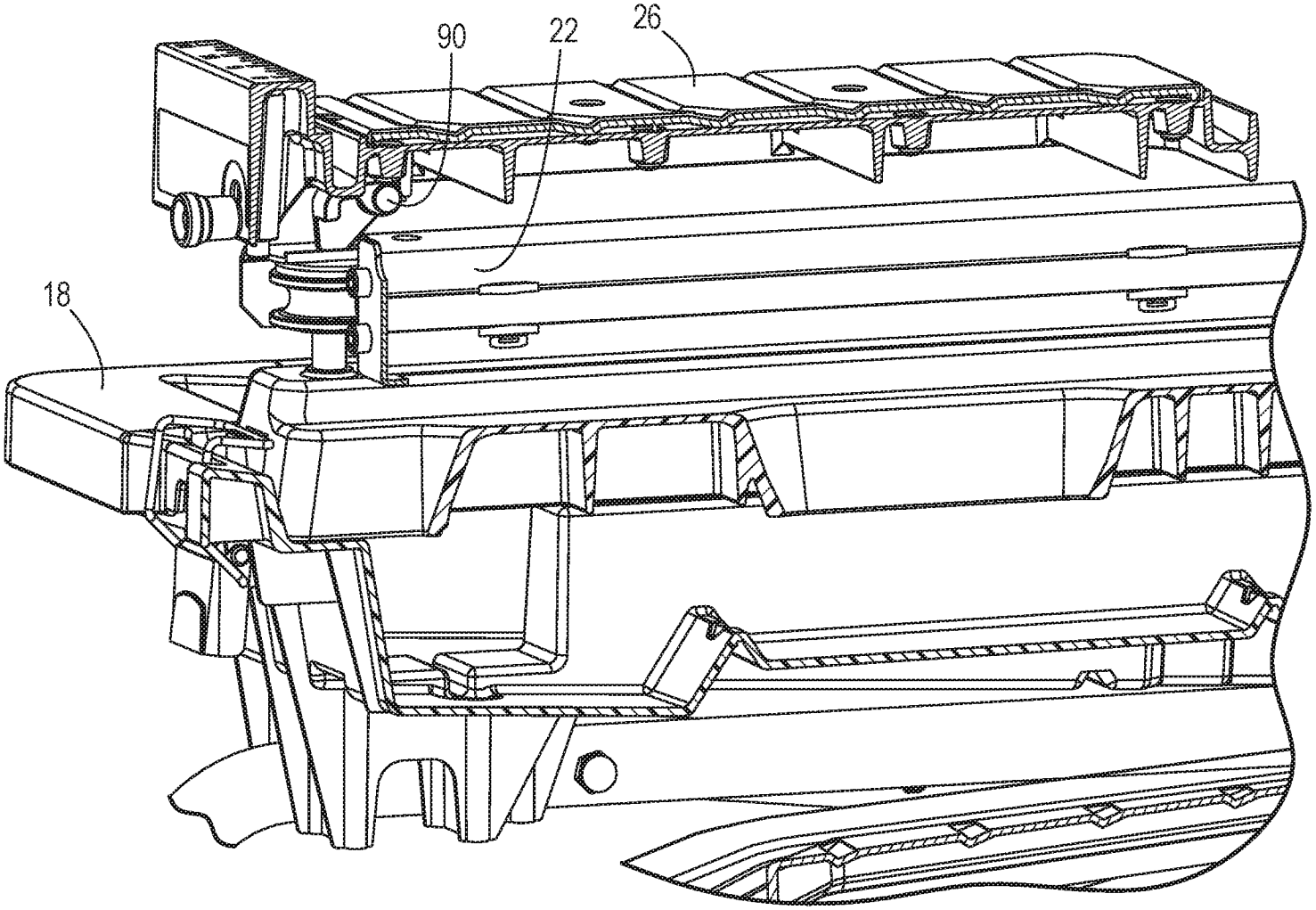
FIG. 6 is an enlarged cross sectional view of the tile saw revealing the joining mechanism of FIG. 4.
Figure 7:
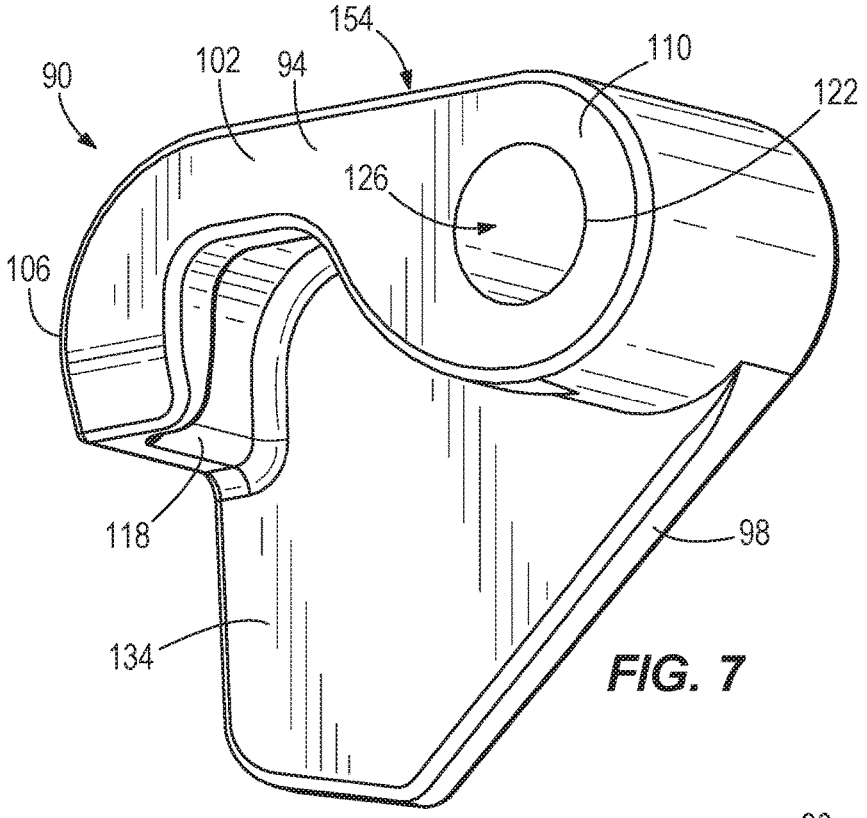
FIGS. 7 and 8 are front views of the joining mechanism of FIG. 4.
Figure 8:
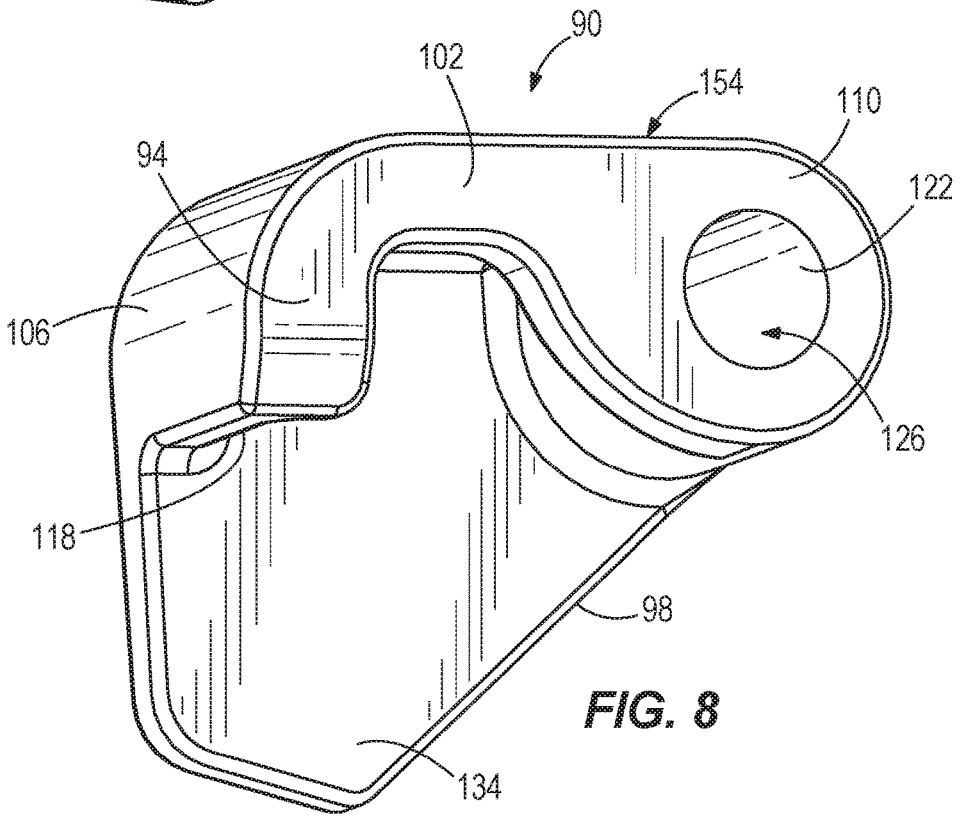
Figure 9:
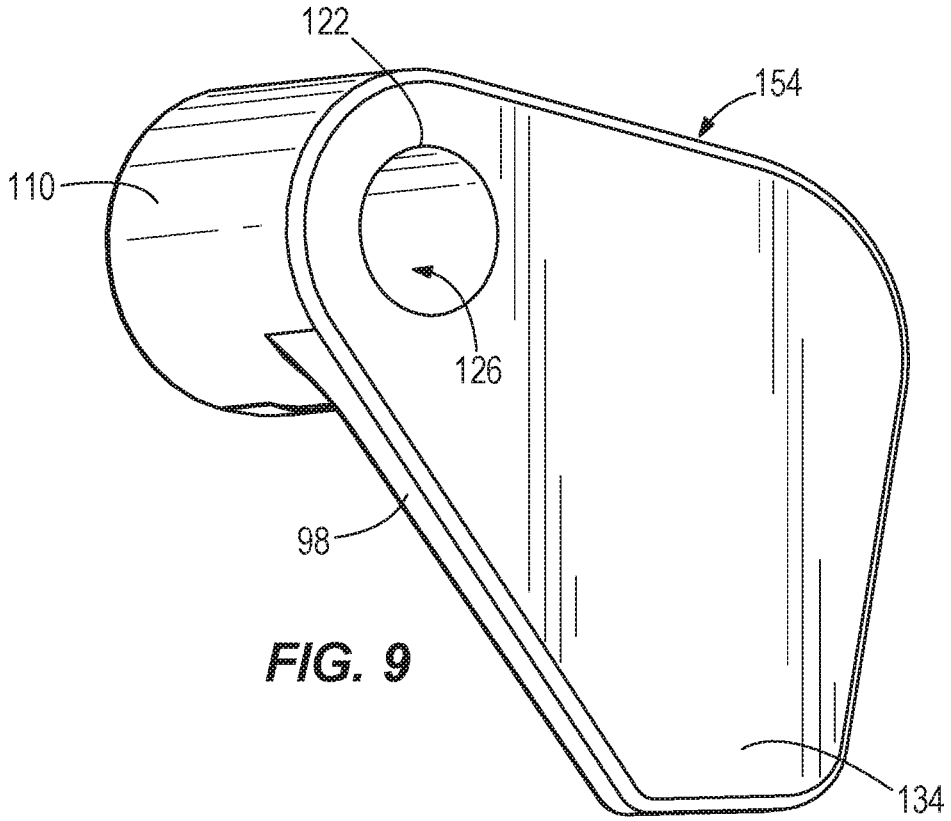
FIG. 9 is a back view of the joining mechanism of FIG. 4.
Figure 10:
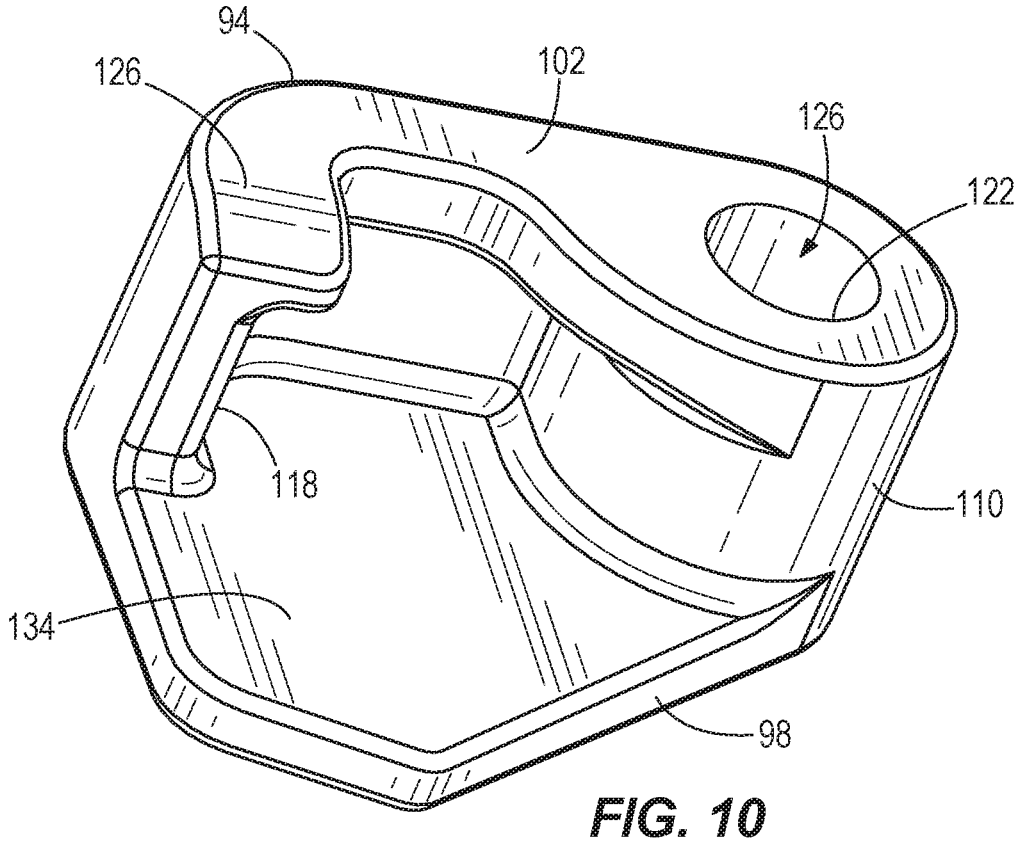
FIG. 10 is a bottom view of the joining mechanism of FIG. 4.
Figure 12:
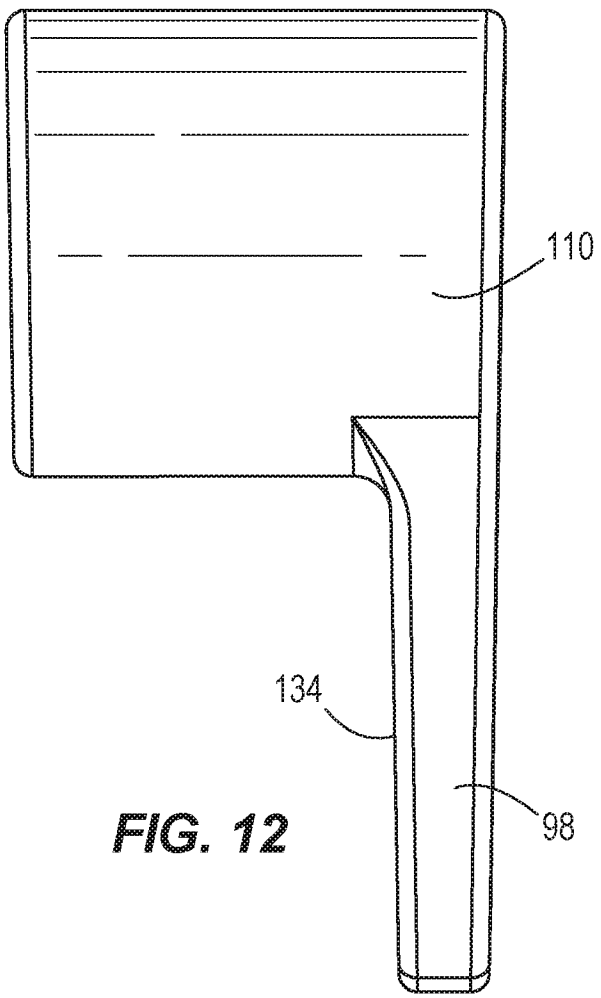
FIG. 12 is another side view of the joining mechanism of FIG. 4.
Figure 11:
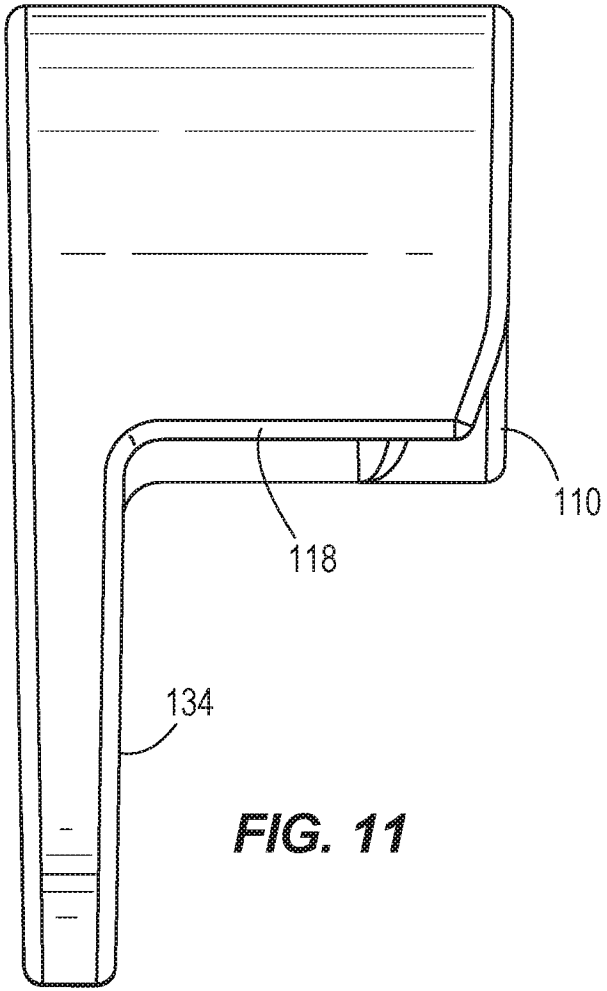
FIG. 11 is a side view of the joining mechanism of FIG. 4.

Accordingly, the carriage 22 and the table 26 are selectively fixed relative to one another. When the carriage 22 and the table 26 move between the first position 70 and the second position 74, they are fixed relative to one another. When the table 26 moves to the first extended position 82 or the second extended position 86, the table 26 is released from the carriage 22. The carriage 22 and the table 26 are selectively fixed by a joining mechanism 90. With reference to FIGS. 4-6, the joining mechanism 90 is fixed to the table 26. Specifically, the joining mechanism 90 extends from an underside 114 of the table 26 and adjacent to the carriage 22. When the table 26 translates relative to the carriage 22, the joining mechanism 90 slides alongside the carriage 22 and parallel to the first and second rails 46, 50 (see, FIGS. 2 and 6).

FIGS. 7-12 illustrate one embodiment of the joining mechanism 90. The illustrated joining mechanism 90 includes a hook 94 and a cam surface 98 that are preferable formed as a single unitary piece or component. The hook 94 includes a shank 102, a bend 106, and an eye 110. The shank 102 extends between the bend 106 and the eye 110. The bend 106 extends from one end of the shank 102 in a generally perpendicular direction. The bend 106 includes three edges that form a U-shaped latching region 118. The bend 106 engages with carriage 22 via the latching region 118 to selectively fix the carriage 22 to the table 26. The eye 110 is disposed on a second end of the shank 102 opposite the bend 106 and defines a pivot point 122 for the joining mechanism 90. The illustrated eye 110 is generally cylindrical in shape and includes a through hole 126 for receiving a fastener 130. The fastener 130 extends through the eye 110 and rotatably couples the joining mechanism 90 to the table 26. In the illustrated embodiment, the fastener 130 is a bolt that creates a pivot axis around which the joining mechanism 90 can rotate. In other embodiments, different types of fasteners, pins, etc. are used to rotatably couple the joining mechanism 90 to the table 26.

Figure 19:
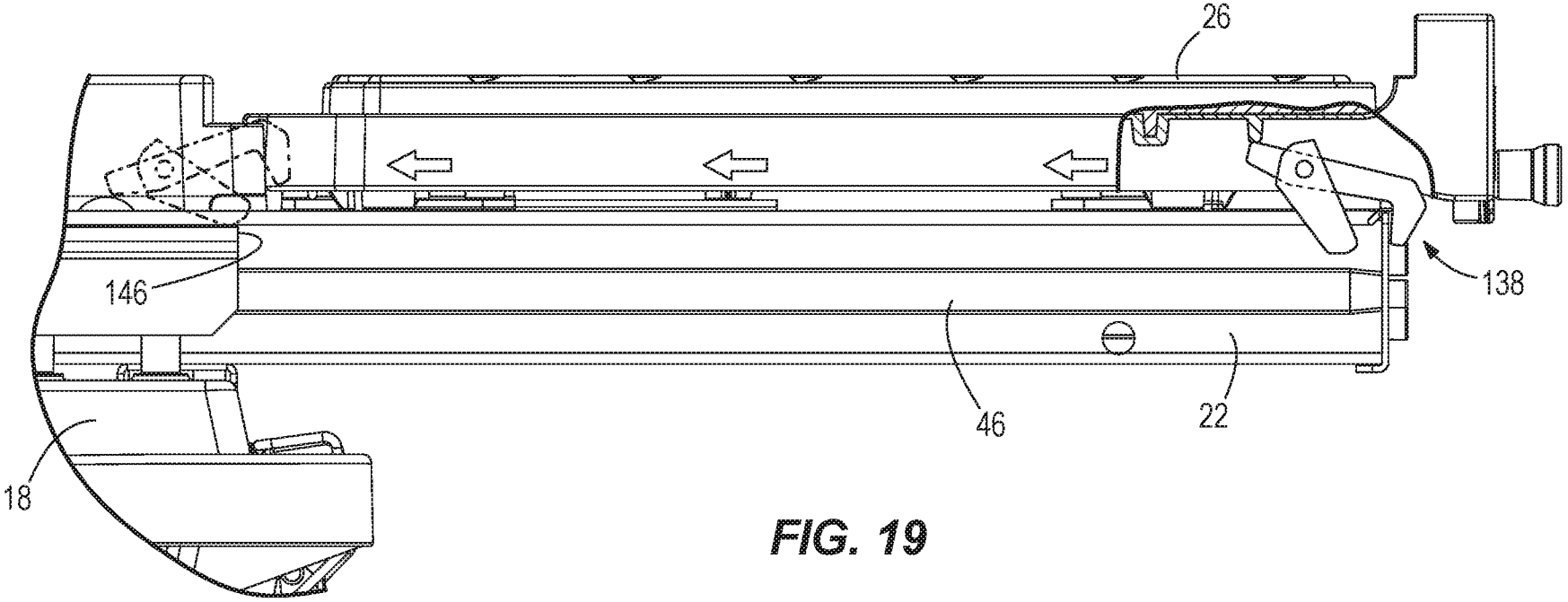
FIG. 19 is a schematic diagram illustrating the joining mechanism engaging with a catch point and a release mechanism.

The hook 94 and the cam surface 98 of the joining mechanism 90 are rotatably fixed relative to one another. The cam surface 98 extends from the eye 110 of the hook 94 in a direction away from the shank 102. For example, in the illustrated embodiment, the cam surface 98 extends from the eye 110 and forms an acute angle with the shank 102. In other embodiments, the cam surface 98 forms a right angle or an obtuse angle with the shank 102. In the illustrated embodiment, the cam surface 98 is formed along an edge of a plate 134. The plate 134 connects the hook 94 and the cam surface 98. In other embodiments, the hook 94 and the cam surface 98 are only connected at the pivot point 122. For example, FIG. 19 illustrates a joining mechanism 90 formed by a hook 94 and a cam that are two separate pieces connected at a pivot point 122.

Figure 13:
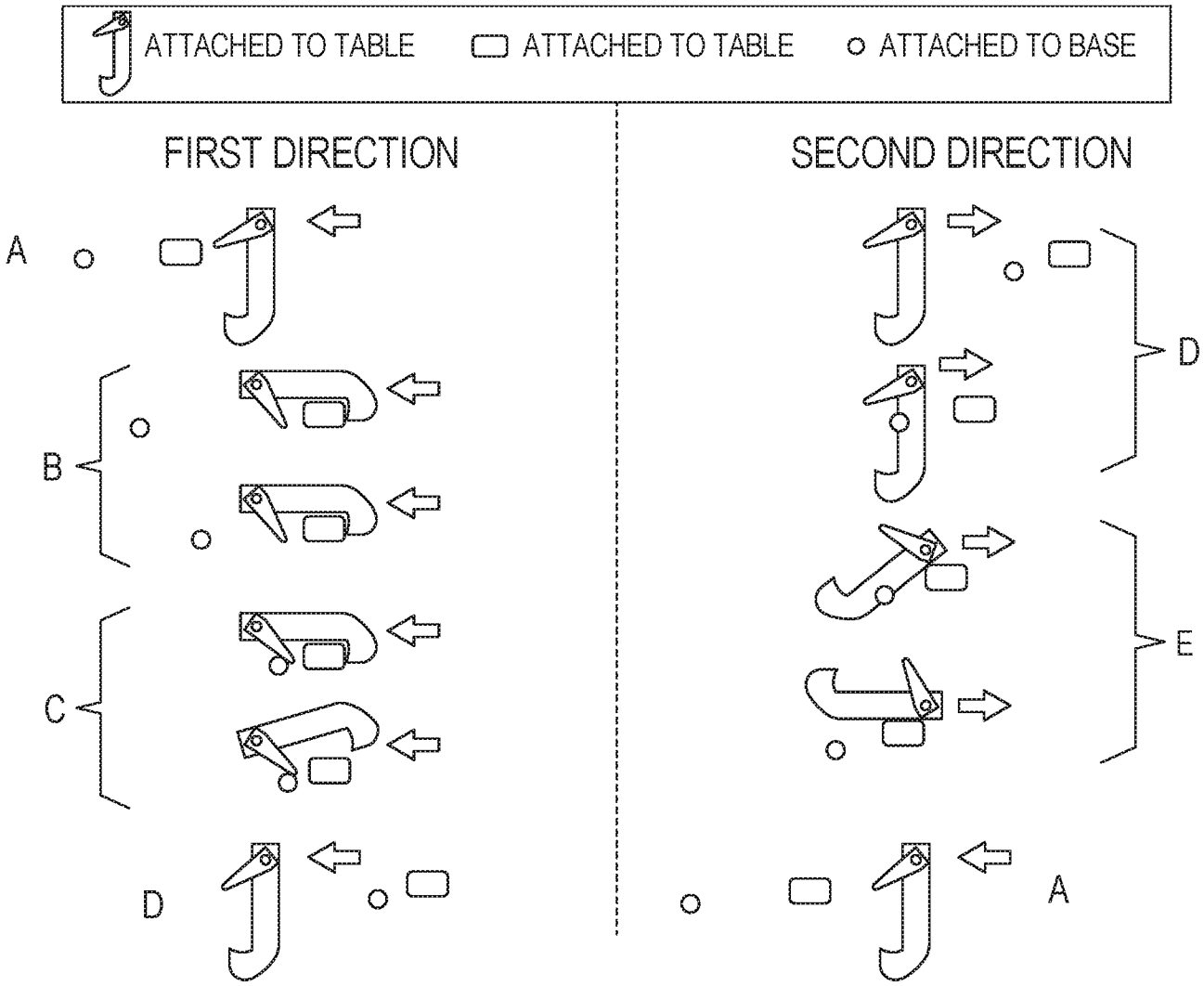
FIG. 13 is a schematic diagram illustrating the movement of the joining mechanism as it interacts with a catch point and a release point.

As illustrated in FIGS. 13-19, the joining mechanism 90 selectively fixes the table 26 to the carriage 22. FIG. 13 provides schematic illustrations of how the joining mechanism 90 latches onto the carriage 22 and releases the carriage 22. Specifically, the left-hand column illustrates how the joining mechanism 90 assists in the movement of the carriage 22 and the table 26 in a first direction, for example, from the first position 70 (or first extended position 82) to the second position 74 (or second extended position 86). The right-hand column illustrates how the joining mechanism 90 assists in the movement of the carriage 22 and the table 26 in a second direction, from the second position 74 (or second extended position 86) to the first position 70 (or first extended position 82). FIGS. 14-19 include more detailed views of some (but not all) of the steps schematically illustrated in FIG. 13.

Figure 14:
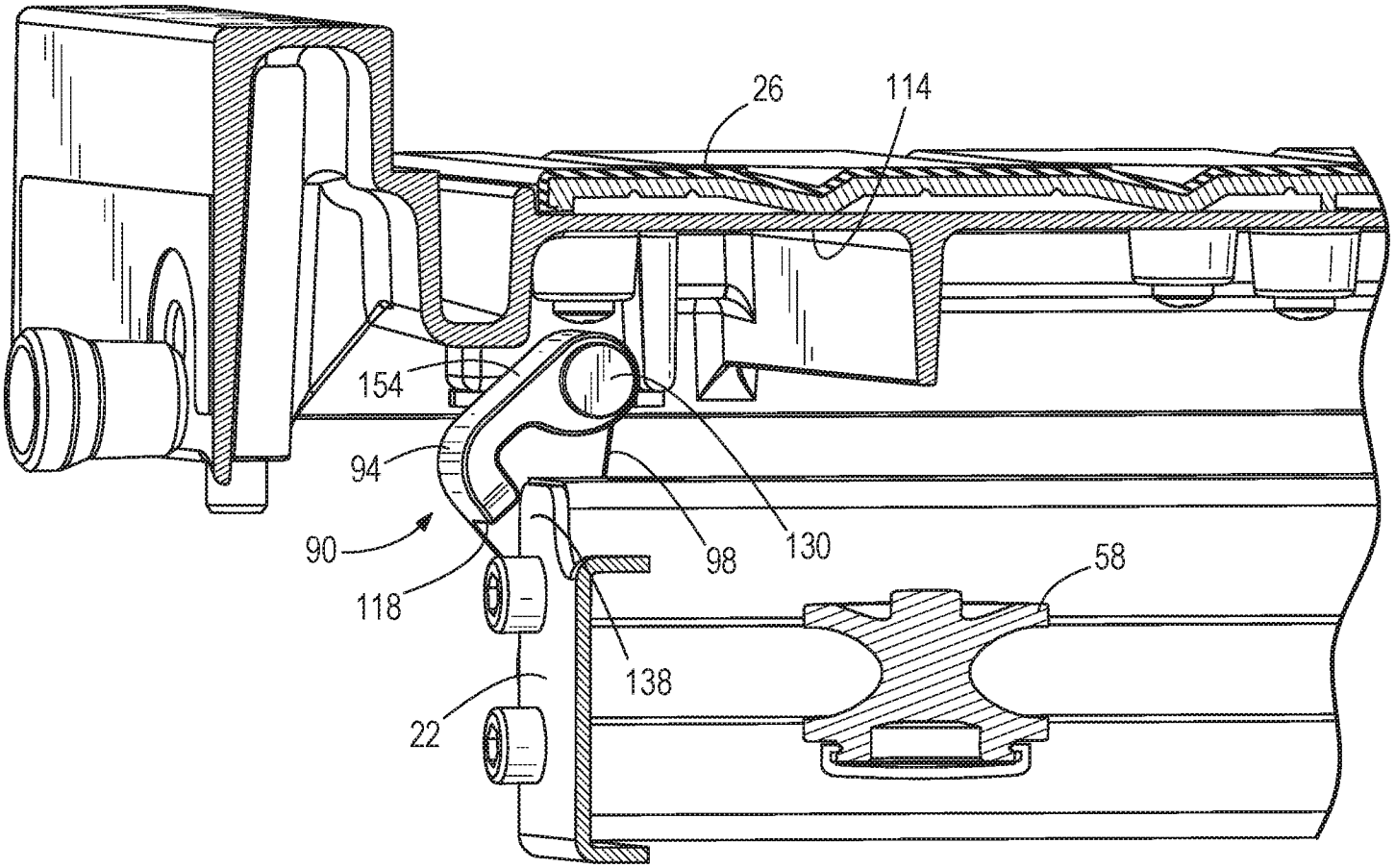
FIG. 14 is a front view of the joining mechanism as it engages with a catch point of the carriage.
Figure 15:
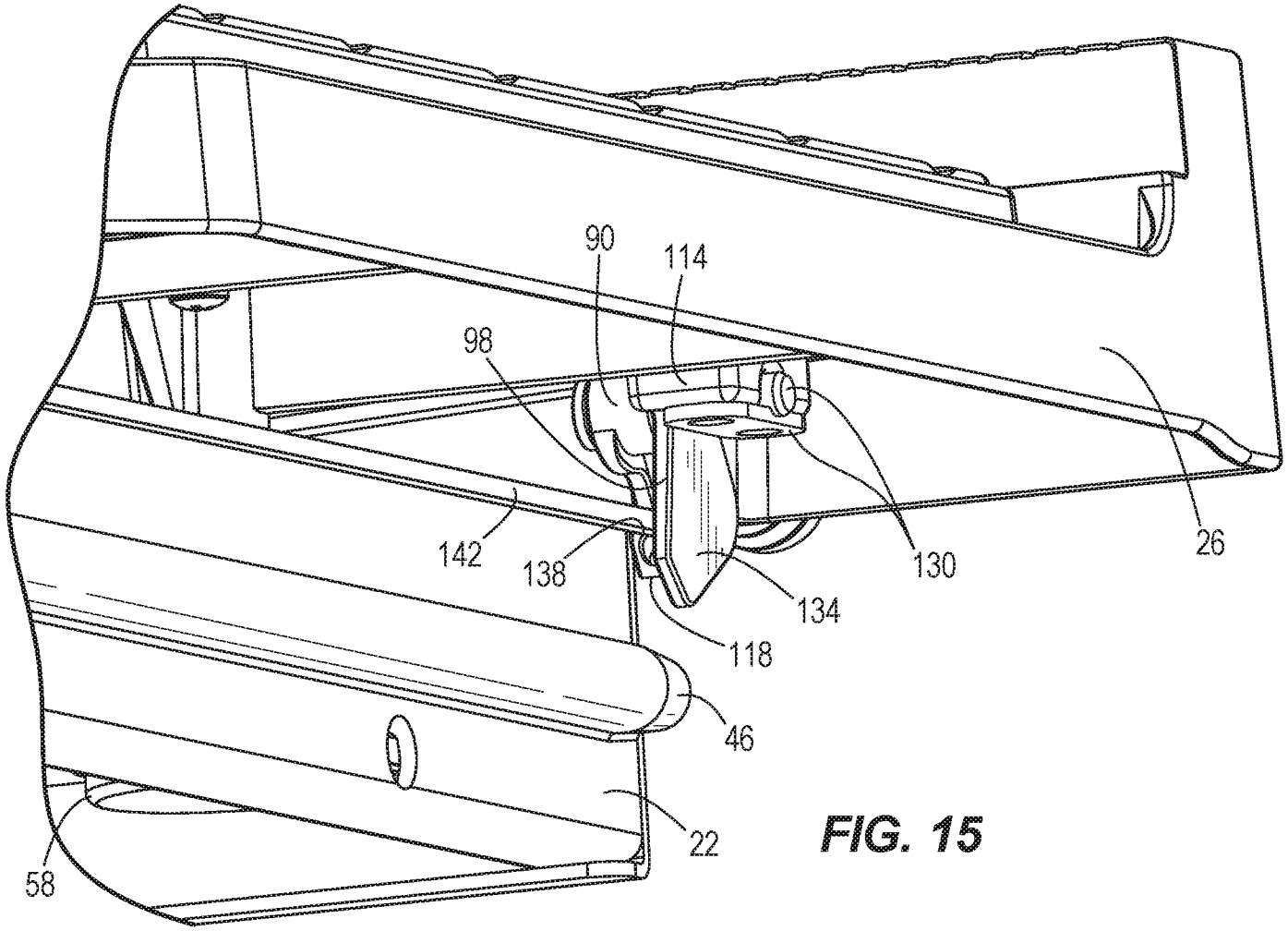
FIG. 15 is a back view of the joining mechanism as it engages with a catch point of the carriage.

The following describes the movement of the table 26 and the carriage 22 in the first direction, as illustrated in the left column of FIG. 13. When the table 26 is in the first extended position 82, the joining mechanism 90 hangs freely from the table 26 at a neutral position (see, orientation A, FIG. 13). As the table 26 moves from the first extended position 82 toward the first position 70, the hook 94 latches onto the carriage 22 at a catch point 138 (see, orientation B, FIG. 13). FIGS. 14 and 15 illustrate one embodiment of the joining mechanism 90 in the latched position. In the illustrated embodiment, the catch point 138 is formed by a flange 142 extending outwardly from the carriage 22. The hook 94 latches on to an edge of the flange 142 such that the flange 142 is received within the U-shaped latching region 118. In other embodiments, the catch point 138 can be formed by a pin or any other protrusion or extension capable of being latched onto by the hook 94. Once the hook 94 latches onto the flange 142, the table 26 and the carriage 22 are fixed relative to one another such that the table 26 and the carriage 22 can move as a single unit. Specifically, movement of the table 26 from the first position 70 to the second position 74 will move the carriage 22 from a first position 70 to a second position 74.

Figure 16:
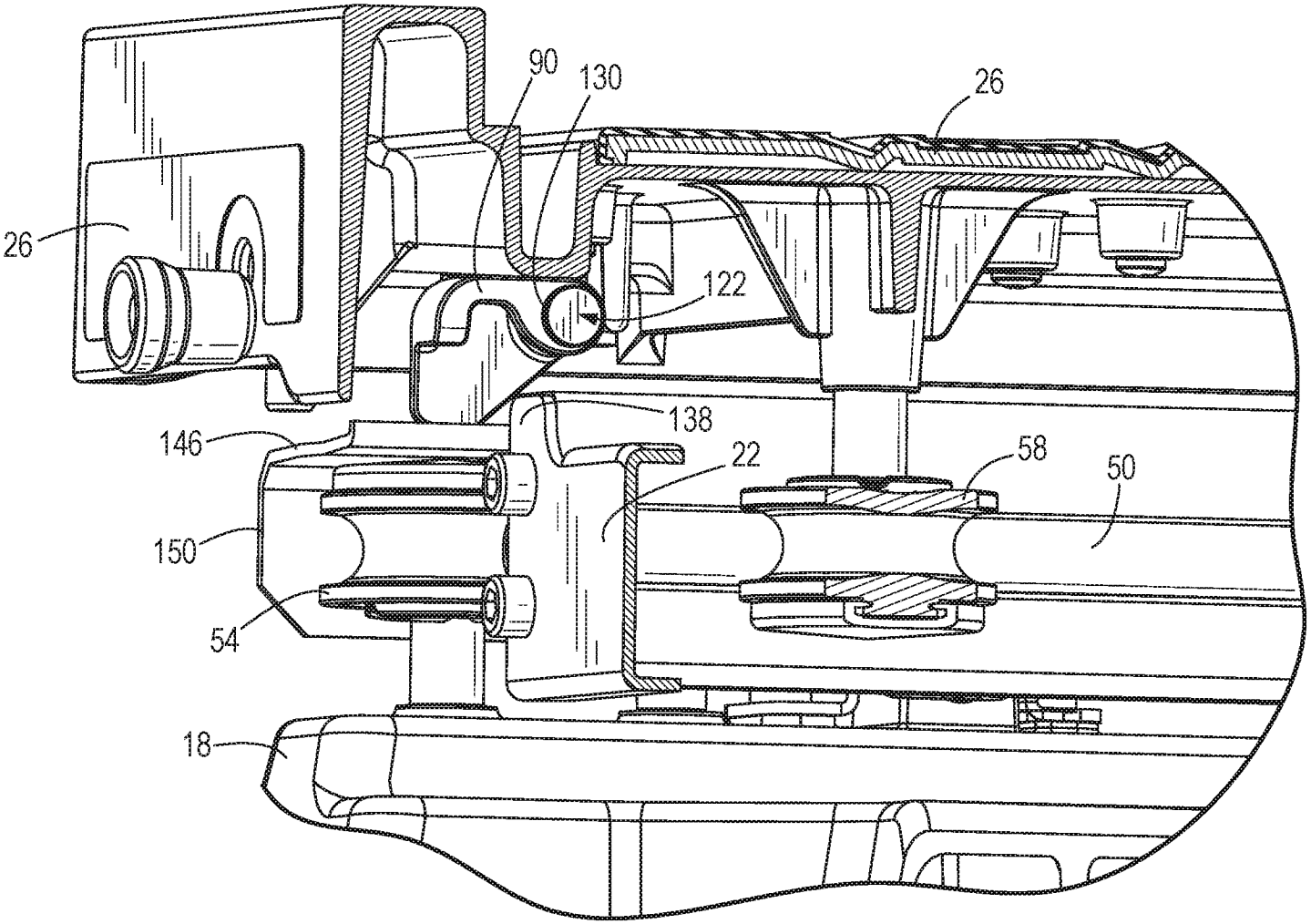
FIG. 16 is a front view of the joining mechanism after releasing the carriage.
Figure 17:
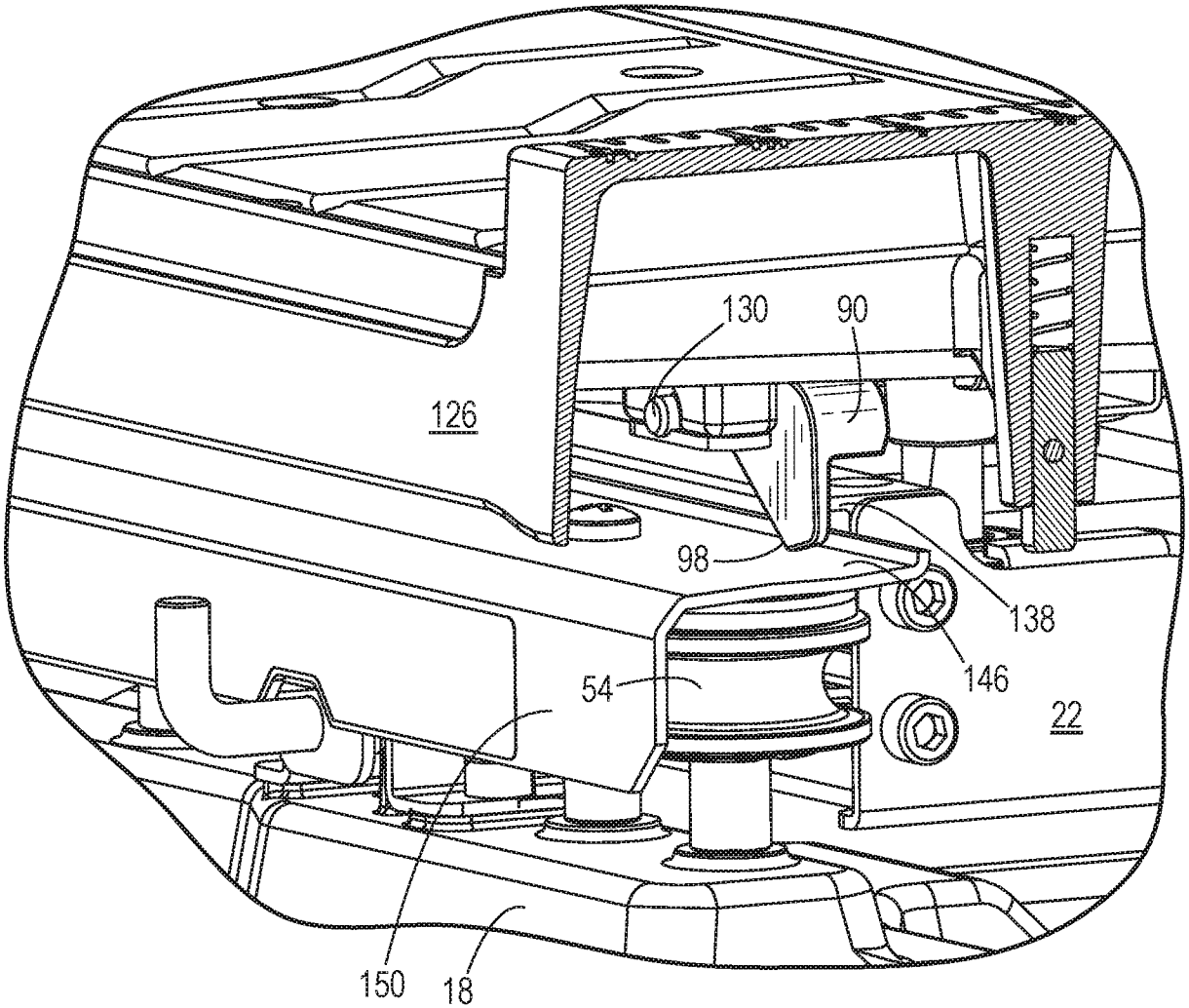
FIG. 17 is a back view of the joining after releasing the carriage.
Figure 18:
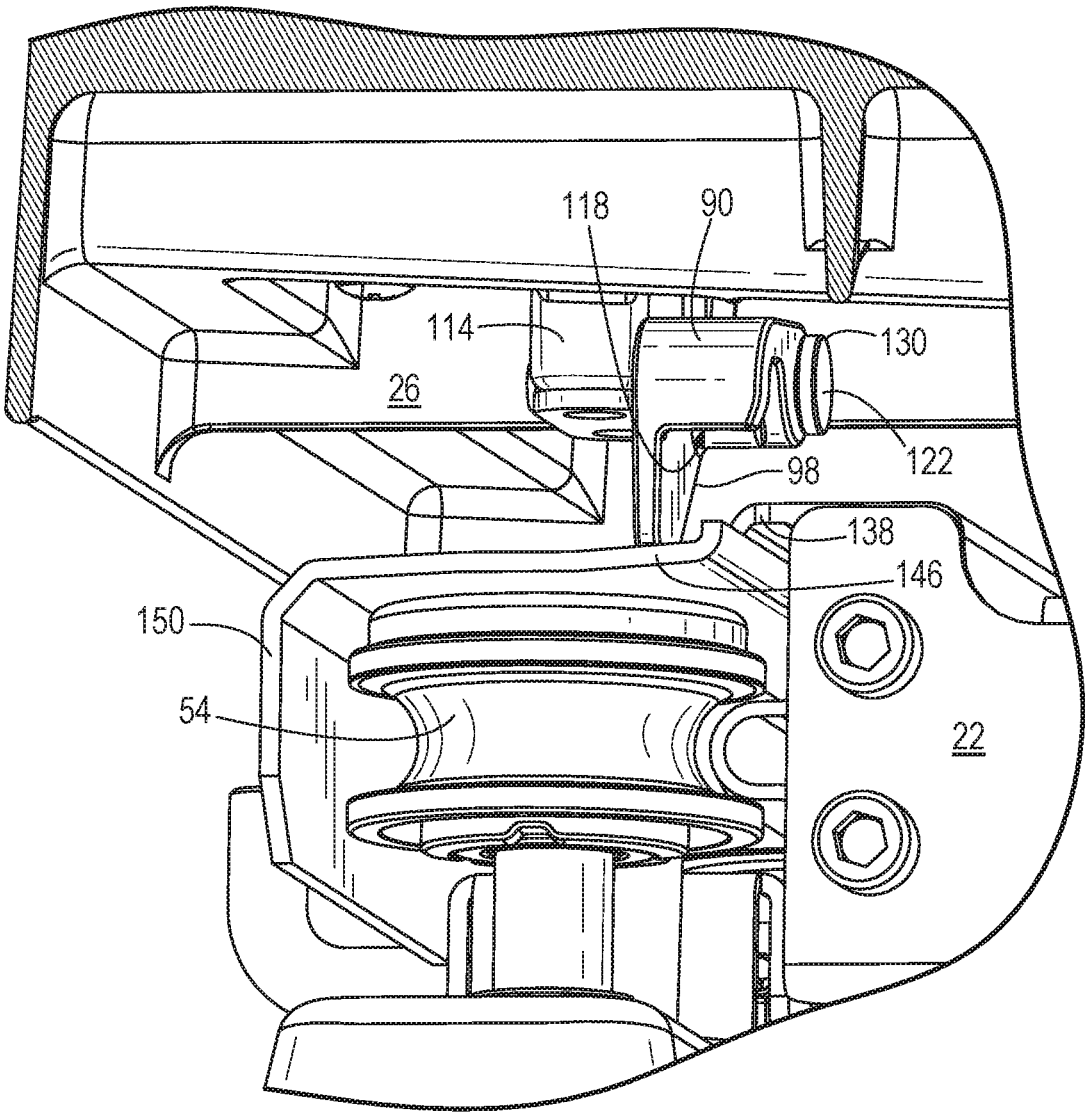
FIG. 18 is a side view of the joining mechanism illustrating the pivotable connection to an underside of the table.

As the table 26 and carriage 22 approach the second position 74, the cam surface 98 contacts a release mechanism 146 (see, orientation C, FIG. 13). The release mechanism 146 pushes against the cam surface 98 to rotate the joining mechanism 90 and unlatch the carriage 22 from the hook 94. FIGS. 16-18 illustrate one embodiment of the joining mechanism 90 in the released position. In the illustrated embodiment, the release mechanism 146 is formed by a shield 150 extending upward from the base 18. In other embodiments, the release mechanism 146 can be formed by a pin or any other protrusion or extension capable of pushing against the cam surface 98 to rotate the joining mechanism 90 and release the carriage 22. Once the carriage 22 is released from the hook 94, the carriage 22 can stop moving along with the table 26. Accordingly, the table 26 can move independently from the carriage 22 between the second position 74 to the second extended position 86. In the illustrated embodiment, as the table 26 moves the cam surface 98 slides along the shield 150, maintaining the joining mechanism 90 in the released position. In other embodiments, for example when a pin forms the release mechanism 146, the joining mechanism 90 simply rotates up and over the release mechanism 146 without sliding along the release mechanism 146. Once the joining mechanism 90 moves beyond the release mechanism 146, the joining mechanism 90 can drop to the free hanging neutral position (see, orientation D, FIG. 13).

The table 26 and the carriage 22 can move in a second direction to return to the first extended position 82. When the table 26 and the carriage 22 move in a second direction, the table 26 begins in the second extended position 86 with the hook 94 hanging freely in the neutral position (see, orientation D, FIG. 13). As the table 26 slides from the second extended position 86 to the second position 74, the table 26 slides with respect to the carriage 22. When the joining mechanism 90 approaches the release mechanism 146, the hook 94 contacts the release mechanism 146 (see, orientation E, FIG. 13). The release mechanism 146 pushes against the hook 94 to rotate the joining mechanism 90 upward. In other words, an edge of the hook 94 acts as a second cam surface 154 to rotate the joining mechanism 90. When the joining mechanism 90 is rotated upward, the joining mechanism 90 can move beyond the release mechanism 146 and return to the neutral hanging position such that the carriage does not connect to the table (see, orientation A, FIG. 13).

The embodiment described above and illustrated in the figures are presented by way of example only and are not intended as a limitation upon the concepts and principles of the present invention. As such, it will be appreciated that various changes in the elements and their configuration and arrangement are possible without departing from the spirit and scope of the present invention.

What is claimed is:

1. A tile saw, comprising:

a saw unit including a motor and a saw blade;

a base supporting the saw unit above the base, the base fixed relative to the saw unit;

a carriage supported by the base, the carriage being translatable relative to the base, the carriage translatable along a first plane;

a table for supporting a work piece to be cut by the saw blade, the table being translatable relative to the base, the table translatable along a second plane, the second plane being parallel to the first plane, wherein the table is selectively translatable relative to the carriage;

a catch point on one of the table and the carriage;

a release mechanism on one of the table and the carriage; and a joining mechanism configured to selectively fix the table to the carriage, wherein the joining mechanism fixes the table to the carriage in response to the joining mechanism engaging with the catch point while the table translates in a first direction, wherein the joining mechanism releases the table from the carriage in response to the joining mechanism engaging with the release mechanism while the table translates in the first direction, and wherein the carriage translates with the table in at least the first direction and a second direction when fixed to the table.

2. The tile saw of claim 1, wherein the carriage is translatable along a first distance extending between a first position and a second position, and wherein the table is translatable along a second distance extending between a first extended position and a second extended position, the second distance being different from the first distance.

3. The tile saw of claim 2, wherein the second distance is greater than the first distance.

4. The tile saw of claim 2, wherein the first position, the second position, the first extended position, and the second extended position are collinear.

5. The tile saw of claim 4, wherein the first position and the second position are positioned between the first extended position and the second extended position.

6. The tile saw of claim 5, wherein the carriage and the table are fixed relative to one another when the carriage and the table translate between the first position and the second position, and wherein the table is translatable relative to the carriage when moving along an additional distance between the first position and the first extended position.

7. The tile saw of claim 1, wherein the carriage includes a first rail and a second rail, the first rail enabling movement between the carriage and the base, the second rail enabling movement between the carriage and the table.

8. The tile saw of claim 7, further including a first set of rollers coupled to the base and a second set of rollers coupled to the table, the first set of rollers engagable with the first rail, the second set of rollers engagable with the second rail.

9. The tile saw of claim 8, wherein at least one of the first set of rollers and the second set of rollers rotates about an axis that is perpendicular to the first plane.

10. The tile saw of claim 1, wherein the carriage is translatable along a first distance between a first position and a second position, and wherein the table is translatable along a second distance between a first extended position and a second extended position, the second distance being different than the first distance.

11. The tile saw of claim 10, wherein the first position, the second position, the first extended position, and the second position are collinear, the first position and the second position being between the first extended position and the second extended position.

12. The tile saw of claim 11, wherein the joining mechanism fixes the table to the carriage between the first position and the second position such that the table and the carriage translate together relative to one of the base and the saw unit.

13. The tile saw of claim 11, wherein the table is translatable relative to the carriage between the first extended position and the first position.

14. The tile saw of claim 11, wherein the joining mechanism includes a hook and a cam surface.

15. The tile saw of claim 14, wherein, when the table arrives at the first position, the hook latches onto the catch point on one of the table and the carriage to fix the table to the carriage.

16. The tile saw of claim 1, wherein the joining mechanism is coupled to the table, and wherein the joining mechanism is slidable relative to the carriage.

17. The tile saw of claim 1, wherein the carriage is translatable along a first distance between a first position and a second position, wherein the table is translatable along a second distance between a first extended position and a second extended position, the second distance being greater than the first distance by an additional distance, and wherein the table is fixed relative to the carriage along the first distance, and wherein the table is translatable relative to the carriage along the additional distance.

18. The tile saw of claim 17, wherein the joining mechanism is coupled to one of the table and the carriage.

19. A tile saw, comprising:

a saw unit including a motor and a saw blade;

a base supporting the saw unit above the base, the base fixed relative to the saw unit;

a carriage supported by the base, the carriage being translatable relative to the base, the carriage translatable along a first plane, the carriage is translatable along a first distance between a first position and a second position, and wherein the table is translatable along a second distance between a first extended position and a second extended position, the second distance being different than the first distance;

a table for supporting a work piece to be cut by the saw blade, the table being translatable relative to the base, the table translatable along a second plane, the second plane being parallel to the first plane, wherein the table is selectively translatable relative to the carriage; and a joining mechanism configured to selectively fix the table to the carriage, wherein the first position, the second position, the first extended position, and the second position are collinear, the first position and the second position being between the first extended position and the second extended position, wherein the joining mechanism includes a hook and a cam surface, wherein, when the table arrives at the first position, the hook latches onto a catch point on one of the table and the carriage to fix the table to the carriage, and wherein, when the table arrives at the second position, the cam surface contacts a release mechanism on one of the table and the carriage, the release mechanism disengaging the hook from the catch point such that the table is not fixed relative to the carriage.

20. The tile saw of claim 19, wherein the hook and the cam surface are both rotatable about a pivot point, and wherein the hook and the cam surface are rotatably fixed relative to one another such that rotation of the cam surface causes rotation of the hook.

* * * * *